United States Patent [19]

Korte

[11] Patent Number: 4,880,114

[45] Date of Patent: Nov. 14, 1989

[54] PACKAGE

[76] Inventor: Heinrich Korte, Grosswolder Strasse 60, D-2957 Westoverledingen 1, Fed. Rep. of Germany

[21] Appl. No.: 215,687

[22] Filed: Jul. 6, 1988

[30] Foreign Application Priority Data

Jul. 9, 1987 [DE] Fed. Rep. of Germany ... 8709437[U]

[51] Int. Cl.[4] ..... B65D 85/42

[52] U.S. Cl. ..... 206/418; 206/446; 206/591

[58] Field of Search ..... 206/418, 446, 591

[56] References Cited

U.S. PATENT DOCUMENTS

| | | | |
|---|---|---|---|
| 668,705 | 2/1901 | Baskerville | 206/418 X |
| 2,692,077 | 10/1954 | Kuhlman | 206/418 X |
| 3,973,675 | 10/1976 | Brand et al. | 206/418 |

*Primary Examiner*—Arnold Rosenthal

*Attorney, Agent, or Firm*—Kline, Rommel & Colbert

[57] ABSTRACT

A package, in particular for use with fluorescent tubes, is open at the ends and has close to the ends naps protruding to the inside of the package. The naps protrude to the interior to such extend that the packed items, e.g the fluorescent tube, cannot slide out the package by itself.

20 Claims, 1 Drawing Sheet

PACKAGE

SUMMARY OF THE INVENTION

With respect thereto the invention is based on the problem of creating a package, in particular for fluorescent tubes, which can easily be manufactured, handled and be used more than once, the fluorescent tube being held in the container.

For solving this problem the package of the present invention is characterized in that it is open at the ends and close to the ends has naps protruding to the interior of the package.

In the package according to the present invention the naps protrude to the interior to such extend that the packed item, e.g. the fluorescent tube, cannot slide out of the package by itsself. For inserting the fluorescent tube the side walls of the package are widened or are pressed to the outside, till they can move to the inside into their resting position on both ends of the fluorescent tube. Thereafter they fix the fluorescent tube in its position. The package may be made of boxboard or of another sufficiently robust packing material. The only requirement is that the material protects the item packed and on the other hand permits an evasive movement of the naps when the item is inserted or removed. The cross-sectional shape of the package may be rectangular, polygonal or round.

A further preferred embodiment of the package under the present invention is characterized in that the package has a rectangular cross-sectional area. In case of the rectangular cross-sectional shape of the package the side walls with the naps can easily give way when the item to be packed is inserted into the package or is removed therefrom.

A further preferred embodiment of the package under the present invention is characterized in that the naps are disposed on a cross-sectional plane of the package. This configuration guarantees that the items packed are securely held at both ends.

A further preferred embodiment of the package under the present invention is characterized in that the naps have a frustrum-conical shape. Said frustrum-conical shape of the naps makes sure that the item to be packed will not get stuck at the naps when being inserted or removed and that the naps are evenly pressed to the outside while the item to be packed slides with its front surfaces along the ramp-shaped sides of the naps.

Finally a preferred embodiment of the package under the present invention is characterized in that in case of a square cross-sectional shape the naps are disposed in the middle of the package side walls. In practice one nap per package side is sufficient for achieving the desired effect.

LIST OF FIGURES

A preferred embodiment of the package under the present invention will in the following be described with reference to the enclosed drawings. In the drawings FIG. 1 is a partly cut side view of a package;

DETAILED ACCOUNT OF WORKING EXAMPLE OF THE INVENTION

Figure 1:
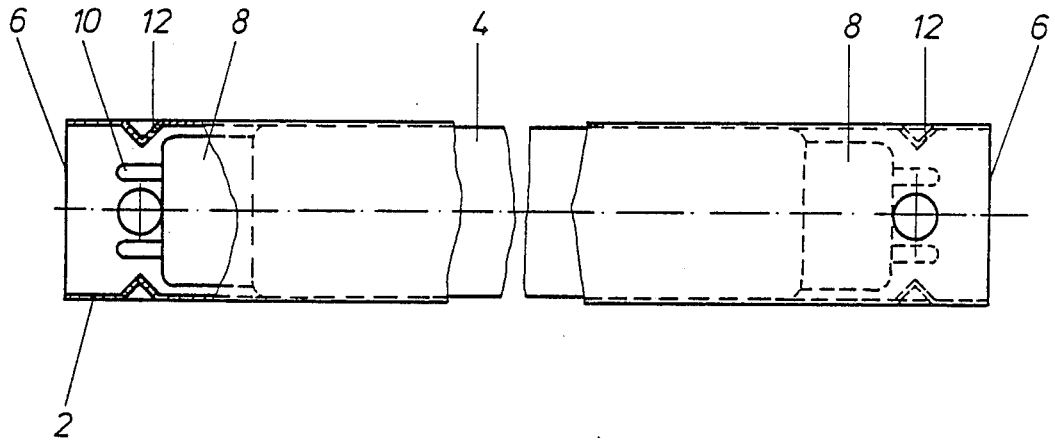

FIG. 1 shows the package 2 with the fluorescent tube 2 lodged therein, wherein said parts for the sake of simplification are shown in a half-cut-away manner in the middle and partly are shown in cut manner. The package 2 is at both ends 6 formed open and identical. The fluorescent tube 4 has a socket 8 and a connecting pin 10. The package 2 at both ends of the fluorescent tube 4 projects thereover and has naps 12 in the vicinity of the ends 6, which naps extend to the inside from the sides of the package in such manner that they protrude further into the inside of the package 2 than it would correspond to the outer diameter of the socket 8 of the fluorescent tube 4. Therefore, the fluorescent tube 4 cannot slide out of the package 2 by itsself.

Figure 2:
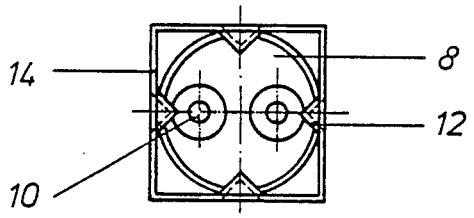
FIG. 2 is an end view of the package.

As can be seen from FIG. 2, the naps 12 are impressed or embossed into the side walls 14 of the package 2 in the form of imprints or recesses. In the shown embodiment the package is of square shape, the naps 12 are located in a cross-sectional plane of the package 2 and each in the middle of a side 14 of the package 2. The naps have a frustrum-concial cross section in order to render it simple to insert the fluorescent tube 4 into the package or the remove it therefrom.

Figure 3:
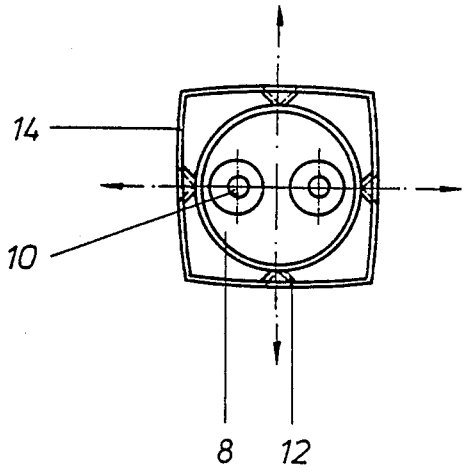
FIG. 3 is an end view of the package, a fluorescent tube just being inserted therein or removed therefrom.

In FIG. 3 the condition is shown in which the fluorescent tube 4 just is being removed from or inserted into the package 2. The naps 12 are in touch with the outer circumference of the fluorescent tube 4 and the side walls 14 are pressed to the outside. The naps 12 therein remain almost stable and are but slightly deformed. Since during removal of the fluorescent tube 4 from the package 2 the naps always remain in contact with the fluorescent tube 4, the fluorescent tube 4 is prevented from inadvertently sliding out of the package 2. As during the insertion or removal of the fluorescent tube 4 the package 2 or parts thereof are not distroyed it is possible to again make use of the package.

What is claimed is:

1. A package for an item such as a fluorescent tube and the like and comprising an elongated open ended body portion having a cross sectional configuration for suitably receiving an item therewithin, said body portion including at least a pair of opposed naps adjacent each open end thereof for retaining an item within said body portion, said naps being spaced inwardly from the open end of said body portion to which they are adjacent and extending inwardly of said body portion to protrude therewithin beyond the outer dimension of the item to be received therewithin, said naps adjacent one end of said body portion being spaced apart from said naps adjacent the other end of said body portion in juxtarelation to respectively protrude inwardly of said body portion adjacent an outer end of the item received therewithin.

2. A package as specified in claim 1 wherein said naps have the shape of a cone frustum.

3. A package as specified in claim 1 wherein said body portion has a rectangular cross sectional area and said opposed naps are disposed at opposite sides thereof.

4. A package as specified in claim 3 wherein said naps are disposed substantially centrally of the opposite sides thereof.

5. A package as specified in claim 4 wherein said naps have the shape of a cone frustum.

6. A package as specified in claim 3 wherein said naps have the shape of a cone frustum.

7. A package as specified in claim 3 wherein said body portion is sufficiently flexible to enable the sides thereof to bulge outwardly on insertion of an item as slidably received therewithin past said naps at one end thereof with only slight deformation of said naps whereby said naps maintain their shape for retention of an item as slidably positioned and packaged within said body portion.

8. A package as specified in claim 7 wherein said naps have the shape of a cone frustum.

9. A package as specified in claim 7 wherein said naps are diposed substantially centrally of the opposite sides thereof.

10. A package as specified in claim 9 wherein said naps have the shape of a cone frustum.

11. A package for an item such as a fluorescent tube and the like and comprising an open ended body portion having a rectangular cross sectional configuration for suitably receiving an item therewithin, said body portion including nap means adjacent each open end thereof for retaining an item within said body portion, said nap means being spaced inwardly from the open end of said body portion to which said nap means is adjacent and extending inwardly of said body portion to protrude therewithin beyond the outer dimension of the item to be received therewithin, said nap means adjacent one end of said body portion being spaced apart from said nap means adjacent the other end of said body portion in juxtarelation to respectively protrude inwardly of said body portion adjacent an outer end of the item received therewithin.

12. A package as specified in claim 11 wherein said nap means have the shape of a cone fructum.

13. A package as specified in claim 11 wherein each open end of said body portion includes plurality of nap means disposed in a cross sectional plane to provide opposed nap means at opposite sides thereof.

14. A package as specified in claim 13 wherein said nap means have the shape of a cone fructum.

15. A package as specified in claim 13 wherein said nap means are disposed substantially centrally of the opposite sides thereof.

16. A package as specified in claim 15 wherein said nap means have the shape of a cone fructum.

17. A package as specified in claim 11 wherein said body portion is sufficiently flexible to enable the sides thereof to bulge outwardly on insertion of an item as slidably received therewithin past said nap means at one end thereof with only slight deformation of said nap means whereby to maintain the shape of said nap means for retention of an item as slidably positioned and packaged within said body portion.

18. A package as specified in claim 17 wherein said naps have the shape of a cone fructum.

19. A package as specified in claim 17 wherein said naps are disposed substantially centrally of the opposite sides thereof.

20. A package as specified in claim 19 wherein said naps have the shape of a cone fructum.

* * * * *